United States Patent [19]

Salzgeber et al.

[11] 3,938,911

[45] Feb. 17, 1976

[54] FUEL INJECTION PUMP WITH METERING VALVE CONTROLLED COOLING

[75] Inventors: Daniel Salzgeber, Windsor; Robert Raufeisen; Charles W. Davis, both of Simsbury, all of Conn.

[73] Assignee: Stanadyne, Inc., Windsor, Conn.

[22] Filed: July 31, 1974

[21] Appl. No.: 493,242

Related U.S. Application Data

[62] Division of Ser. No. 336,538, Feb. 28, 1973, Pat. No. 3,861,833.

[52] U.S. Cl. ..... 417/252; 417/310; 417/462

[51] Int. Cl.[2].. F04B 3/00; F04B 49/00; F04B 19/02

[58] Field of Search ..... 417/251, 252, 253, 462, 417/310

[56] References Cited

UNITED STATES PATENTS

| | | | |
|---|---|---|---|
| 2,143,938 | 1/1939 | Chandler | 417/252 |
| 2,641,238 | 6/1953 | Roosa | 417/252 |
| 2,709,339 | 5/1955 | Edelman et al. | 417/252 |
| 3,426,689 | 2/1969 | Drori | 417/252 |
| 3,513,475 | 5/1970 | Austen | 417/252 |

*Primary Examiner*—John J. Vrablik

*Attorney, Agent, or Firm*—Prutzman, Hayes, Kalb & Chilton

[57] ABSTRACT

There is disclosed a rotary distributor type liquid fuel injection pump for delivering measured charges of fuel under high pressure sequentially to the cylinders of an associated engine in timed relation therewith. The pump includes a movable metering valve for regulating the quantity of fuel in the charges. The metering valve also controls a normally closed bypass port which is opened by the metering valve as the metering valve approaches its closed position to continue the circulation of cool fuel from the supply tank through the pump whenever the metering valve is closed as during the downhill coasting of the vehicle on which the pump is mounted.

5 Claims, 7 Drawing Figures

FUEL INJECTION PUMP WITH METERING VALVE CONTROLLED COOLING

This is a division of application Ser. No. 336,538 filed Feb. 28, 1973, now U.S. Pat. No. 3,861,833, which present invention relates to an improved fuel injection pump for compression-ignition engines and the like.

Fuel injection pumps of the type involved in this invention deliver metered charges of liquid fuel under high pressure to the cylinders of an associated engine in timed relationship to their operation. It is desirable that such fuel injection pumps be effective over a wide speed range, effectively govern the engine to provide substantially constant speed operation under widely varying loads, and operate efficiently over relative long periods of time with little or no maintenance. Accordingly, it is a principal object of this invention to provide a new and improved fuel injection pump which meets these requirements.

Another object of this invention is to provide such a fuel pump having a new and improved positive displacement low pressure shuttle for feeding discrete charges of fuel to the high pressure pump chamber wherein charge-to-charge variation in the fuel delivered by the pump is minimized. Included in this object is the provision of such a pump in which the stops at both ends of a pair of alternately operating shuttles are accessible for control and/or easy adjustment in response to desired parameters selected for the operation of operating the pump with precision in the uniformity of charges delivered by the two shuttles.

Another object of this invention is the provision of an improved fuel injection pump in which an improved low inertia shuttle feeding system is utilized.

Still another object of this invention is to provide such a pump wherein the maximum fuel which can be injected at a given engine speed is accurately and automatically controlled at varying levels correlated with engine speed.

A further object of this invention is to provide such a pump having new and improved means for relieving excess pressure in the fuel conduits to plugged nozzles supplied by the pump. Included in this object is the provision of means for fixing the maximum unbalance in the radial forces acting on the distributor or rotor of the pump.

A still further object of this invention is to provide such a pump having a rotor mounted check valve with an improved positive acting closer for the valve to minimize the stresses imposed thereon.

It is also an object of this invention to provide such a pump having means for the continuous cooling of the pump under all operating conditions.

Other objects will be in part obvious and in part pointed out more in detail hereinafter.

A better understanding of the invention will be obtained from the following detailed description and the accompanying drawing of an illustrative application of the invention.

In the drawnigs:

Figure 1:
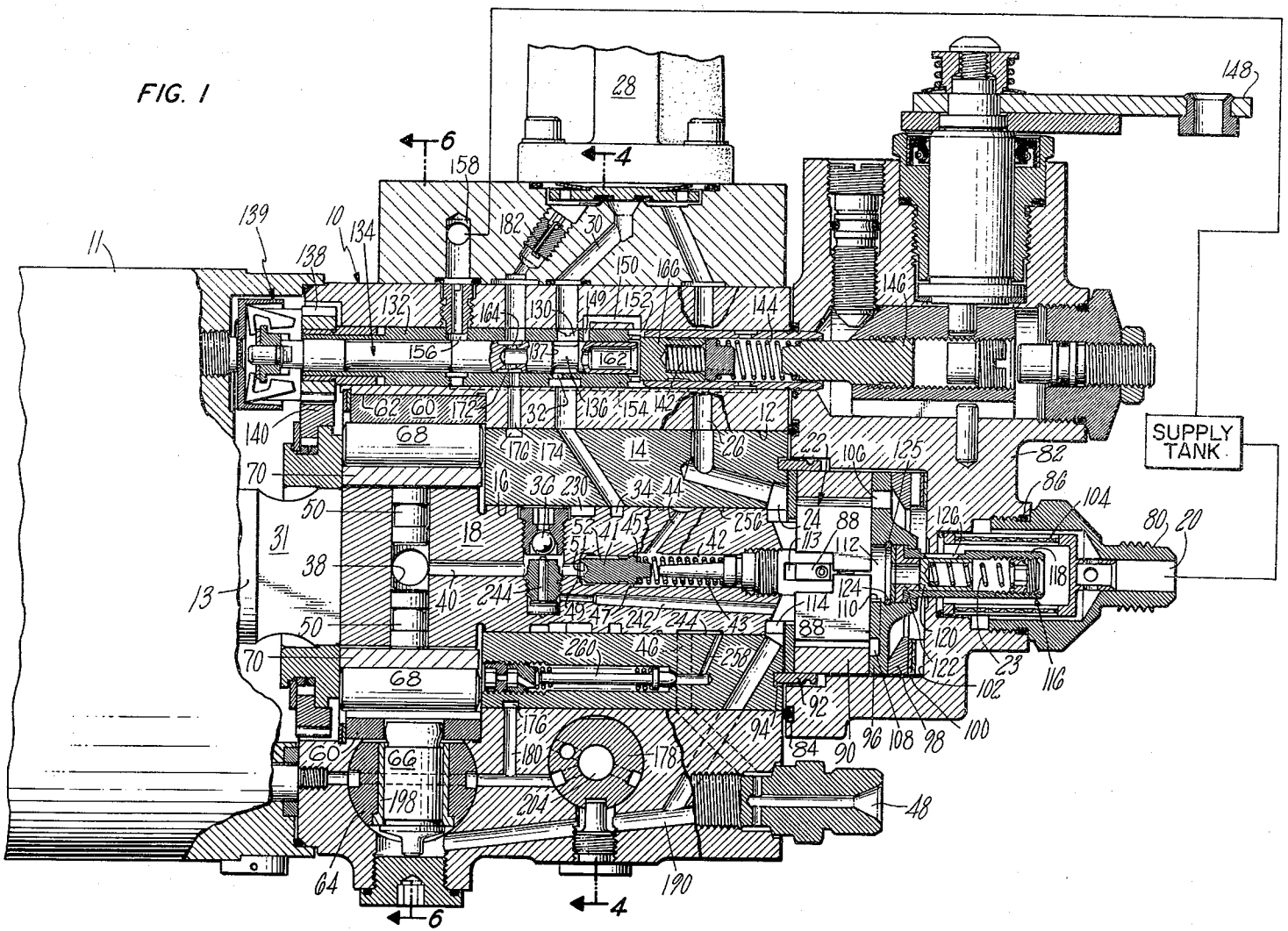
FIG. 1 is a cross-sectional view of an exemplary fuel injection pump embodying the present invention.

Referring now to the drawings in detail, an exemplary pump incorporating the present invention is illustrated. The pump has a hydraulic head 10 with a cylindrical bore 12 in which a sleeve 14 is tightly mounted. The sleeve 14 in turn provides a cylindrical bore 16 in which a distributor rotor 18 is rotatably mounted. Hydraulic head 10 is secured to a drive housing 11 by removable means (not shown). The drive housing includes a mounting flange for attaching the pump to the engine and contains a drive shaft 13 and shaft seals 15.

Briefly stated, fuel from a supply tank (not shown) is delivered to the pump inlet 20 to a vane-type low pressure inlet or supply pump 22, the output of which is pressurized to a pressure correlated with engine speed. The output is delivered to a large annular groove 24, through passage 26, and past an electric shutoff valve 28 which serves to shut off fuel delivery by the pump independent of governor operation. From the shutoff valve, the fuel flows through a passage 30 and a metering port 32 to an annulus 34 formed on the periphery of the distributor rotor 18 with the metered fuel pressure in the annulus 34 having a pressure regulated by the metering valve 134. From the annulus 34, and by way of additional passages including a low pressure shuttle chamber, the fuel flows past a one-way ball check valve 36 in a manner hereinafter more fully described and through axial passage to pump chamber 38.

The pump chamber 38 is shown as being formed by a pair of interescting transverse bores in an enlarged part of the rotor. A pair of opposed plungers 50 are mounted for reciprocating movement in each bore. Surrounding the distributor rotor 18 is a generally annular cam ring 60 which is journaled in a cylindrical recess 62 for a limited arcuate movement and is disposed in the plane of revolution of the plungers 50. The cam ring 60 is restrained from rotating by an adjustable timing advance piston 64 and a connecting pin 66 which interconnects the advance piston 64 and the cam ring 60.

Cam rollers 68 and cam roller shoes 70 are carried by the rotor between the plungers 50 and the cam ring.

When metered fuel is admitted to the pump chamber 38, the plungers 50 move radially outwardly as required to receive the charge of fuel delivered to the pump chamber. At this time, the cam rollers 68 are positioned between adjacent cam lobes of the cam ring 60. Rotation of the rotor 18 then causes the rollers 68 to pass over the cam lobes of cam ring 60 to translate the profile of the cam into reciprocal motion of the plungers to pressurize the charge of fuel in the pump chamber 38 on the inward stroke of the plungers 50.

The fuel is pressurized to a high pressure, say, up to 12,000 psi, in chamber 38, and is delivered through passage 40, past delivery valve 41, and into delivery chamber 42. From the delivery chamber 42, the pressurized fuel flows through diagonal distributing passage 44 which registers sequentially with a plurality of passages 46 to the outlets 48 for sequential delivery to the injector for each of the several cylinders of the associated engine.

The following is a more detailed description of the exemplary pump.

Figure 2:
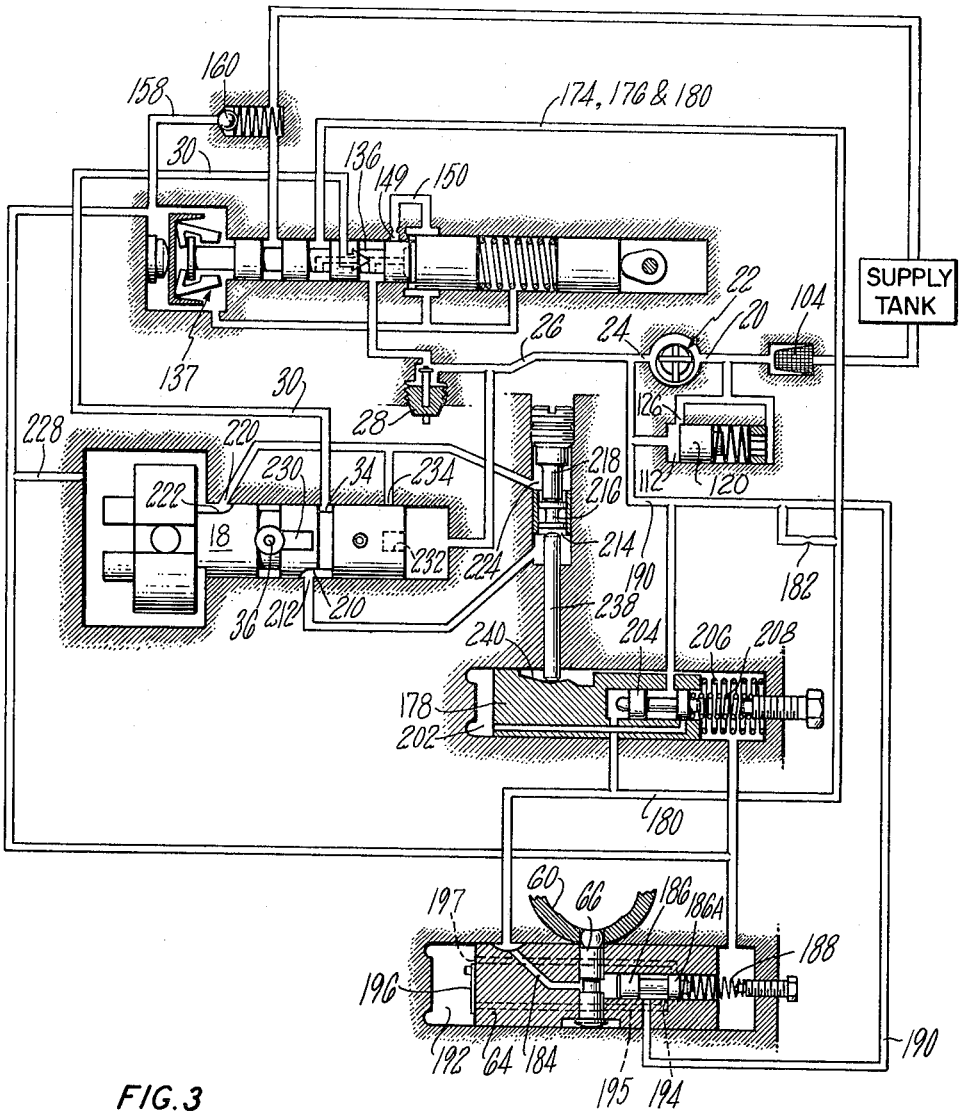
FIG. 2 is a schematic view of the pump of FIG. 1 showing the hydraulic circuits thereof.

Referring particularly to FIGS. 1 and 2, fuel enters the pump through inlet 20 providing a coaxial inlet fitting 80 which threadably engages end cap 82 and is sealed thereto by O-ring 86. End cap 82 provides an annular recess which houses the low pressure or supply inlet pump 22 and is removably secured to the end of the pump housing 10 by suitable means (not shown). O-ring 84 seals the end cap 82 to the housing 10. The vane type inlet pump 22 is a positive displacement pump having a plurality of segmented vanes 88 which are encircled by a liner 90 disposed eccentrically with respect to the axis of rotation of distributor rotor 18. An annular ring 82 having one end received in a circular groove 94 locates the eccentric liner 92. The pump 22 is provided with an end plate 96 which is resiliently biased against the end of the ring 90 by an annular washer 98 and a wave spring washer 100 which bottoms against the end of the annular recess 102 formed in the end cap 82.

Mounted within the inlet fitting 80 is a coaxial inlet strainer 104 through which new fuel entering the pump passes before entering the inlet passage 106 of end plate 96. A kidney shaped arcuate groove 108 formed in the end plate 96 serves as an outlet for the pump 22 from which the fuel flows through a radial slot 110 in end plate 96 to a central cavity 112. From the central cavity 112, the output fuel flows axially through a central passage provided between the segmented vanes 88 and in the radial slots 113 of the rotor 18 which slideably mounts the vanes 88 to hydraulically bias the segmented vanes outwardly into close contact with the inner periphery of the eccentric liner 90. The fuel then flows to the large annulus 114 provided at the end of the distributor rotor 18 immediately adjacent the supply pump 22. The end plate 96 further mounts an axially projecting coaxial pressure regulator generally indicated by the numeral 116. The regulator 116 is provided with a cylindrical housing 118 mounting a valve 120 which is adjustably biased to a closed position against an annular stop 112 such that valve 120 closes spill port 126 in cylindrical housing 118. Stop 122 is fixedly secured in the end plate 96 by a split ring 124 mounted in an annular groove 125 in end plate 96. It is readily apparent that the output pressure from the inlet pump 22 is applied to the end of the valve 120 to open the valve 120 against the bias of spring 23 to spill a portion of the output of the inlet pump 22 to the inlet passage through port 126.

With this construction, the excess fuel from the inlet pump 22 is spilled to the inlet of the pump without flowing through the main portions of the injection pump at or near the precision fitted portions of the rotor 18 in bore 12, so that the heat generated by the pressurizing of the fuel spilled by the regulator 116 is isolated from the rotor to minimize the prospect for localized heating and seizure of the rotor.

Regulated output fuel from pump 22 flows from annulus 24 through passage 26, past shutoff valve 28, through passage 30 to port 130 in governor tube 132. The metering valve 134 rotatably and slideably mounted in governor tube 132, has a necked-down portion 136 aligned with inlet port 130 to provide an annulus 137 within the governor tube. A triangular shaped metering port 32 is provided in the governor tube 132 at an axial position aligned with the shoulder of the metering valve at the left end of annulus 137 so that its degree of opening is determined by the axial position of the metering valve 134 which is connected to rotate with governor flyweight assembly 139 which in turn is driven by the rotor through gears 138, 140.

The governor flyweight assembly 139 exerts an axial force on the metering valve 134 to urge it toward a closed position against the bias of springs 142 and 144 until an equilibrium condition is reached. The spring force of spring 144 is set by a movable seat 146 controlled by the throttle 148 to establish the speed at which equilibrium takes place.

When the flyweight assembly moves the metering valve 134 to the right, as viewed in FIG. 1, to fully close the metering port 32, the wall of metering valve 134 forming the right-hand edge of groove 130 uncovers a port 149 in the governor tube 132 to spill fuel back to the fuel tank by way of passage 150, annulus 152 formed on the outer periphery of governor tube 132, axial passage 154, annulus 156, passage 158, and housing pressure regulating valve 160 (FIG. 2) which maintains a housing pressure of, say, 15 psi. This provides a continuous circulation of cool new fuel from the tank through a pump at all times, including downhill operation when the metering valve is closed.

As shown in FIG. 1, the free end of the metering valve 134 is provided with a drilled axial passage 162. A movable closure 166 is biased against the end of the metering valve 134 by the spring 142 and/or spring 144 to close the drilled passage. Spring 142 has a low spring rate and is effective only at low speed where it provides improved governor operation.

The passage 162 is provided with a port 164 in the side wall of metering valve 134 which communicates with an annulus 172. Output fuel from inlet pump 22 is bled into the annulus 172 through the bleed orifice 182, and the pressure thereof, which is substantially higher at all operating speeds than the pressure in passage 162, causes a slight separation between the end of the metering valve 134 and the closure 166 to spill fuel from passage 162. Since the spring force of spring 144 opposes flyweight force and this force is transmitted hydraulically between closure 166 and metering valve 134, the spill of fuel from passage 162 is in an amount to result in a pressure in passage 162 correlated with flyweight force. Further, since flyweight force is directly proportional to the square of the speed, an equivalently proportioned $N^2$ control pressure is established in passage 162, as well an in annulus 172, passage 174, and annulus 176 to deliver a speed related $N^2$ control pressure to advance piston 64 and fuel limiting plunger 178 through passage 180.

As shown in the schematic flow diagram of FIG. 2, conduit 180 is connected to a passage 184 in advance piston 64 to deliver $N^2$ control pressure to operate a servo piston 186 which acts against the bias of a spring 188 to control the flow of fuel from inlet pump 22 through conduit 190 from the transfer pump to chamber 192 at one end of the advance piston 64 through annulus 194 and passage 195 with reed valve 196 preventing reverse flow through passage 195 and preventing sharp pressure impulses imposed in the trapped fuel in chamber 192 from being present in annulus 194. Passage 197 is provided for dumping fuel from chamber 192 upon a reduction in operating speed. With the axial position of servo valve 186 in equilibrium under the influence of opposing forces of $N^2$ control pressure applied at one end and the spring force of spring 188 at the other, the land 186A of servo valve 186 blocks flow through both conduits 195 and conduit 197. Since the ports of conduit 195 and 197 open into the servo piston chamber radially, only radial forces are exerted on servo valve 186 by the pressure in these conduits. If engine speed decreases, the $N^2$ control pressure will decrease so that servo valve 186 is moved to the left to uncover conduit 197 to dump a portion of the fuel trapped in chamber 192 until a new position of equilibrium of servo valve 186 is reached with a corresponding retardation of the timing of injection. Similarly, upon an increase in engine speed, the $N^2$ control pressure acting on the end of servo valve 186 increases to open the port of conduit 195 for communication with annulus 194 to add fuel to chamber 192 to advance the time of injection, thus providing full servo control of the position of advance piston 64.

As the rollers 68 repeatedly ride up the cam lobes of cam ring 60 to pressurize sequential charges of fuel in the pump chamber 38, it is apparent that sharp intermittent loads of high intensity and minute amplitude will be imparted on the advance piston 64 causing it to vibrate in its bore in both radial and axial directions; the radial motion causing repeated impact loading between the piston and the bore, such that fretting or galling of these surfaces can occur. The magnitude of this radial impact loading is dependent on the radial velocity and mass of the advance piston 64. In the present invention, this undesirable surface destruction is overcome by having the piston made of a light weight material, i.e. aluminum, which is treated to produce a hardened porous surface with the pores filled with polytetrafluoroethylene. As a result, the rate of wear due to fretting corrosion is eliminated and the operational life span of an advance piston is increased. A steel insert 198 is press fit in the crossbore of the advance piston for receiving the connecting pin 66 to prevent the enlargement and deformation of the crossbore under the high stress imposed between the pin 66 and the crossbore due to the repeated impact loads imparted thereon by the operation of the pump.

Figure 6:
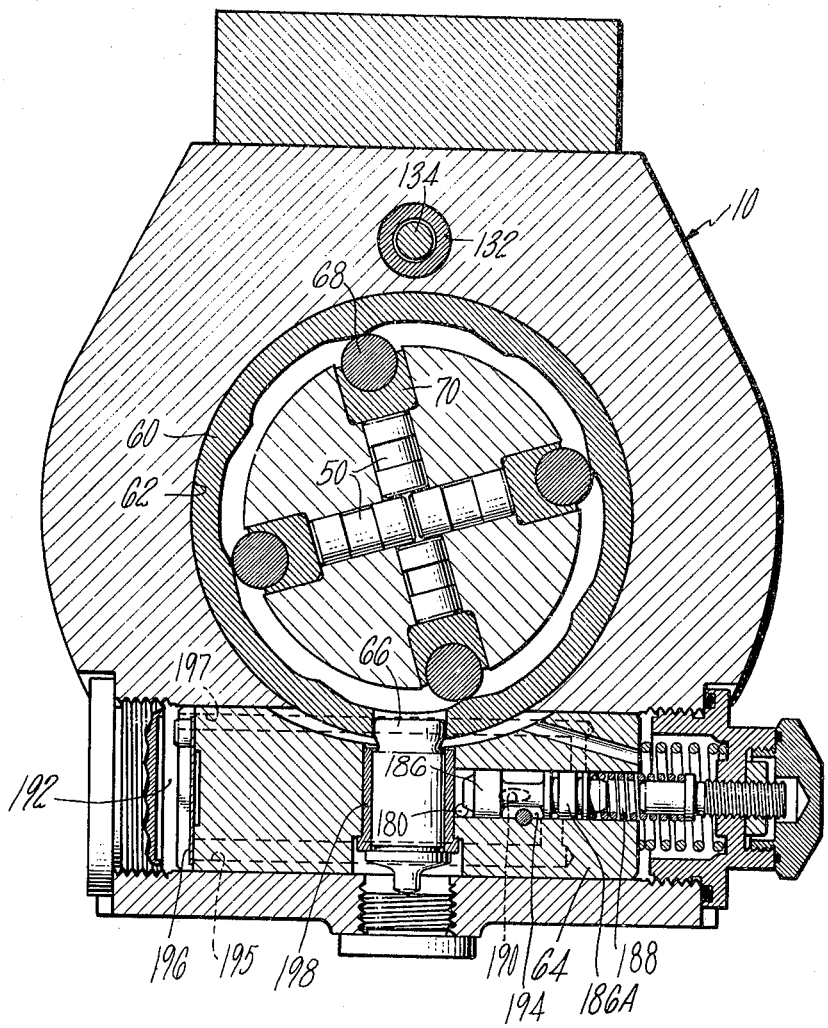
FIG. 6 is a cross-sectional view taken along line 6—6 of FIG. 1

Further, as shown in FIG. 6, a reed valve 196 is attached to the end of the advanced piston 64 covering passage 195 to prevent reverse flow of trapped fuel in the chamber 192 through the passage 195. During pumping, the reaction pressure generated in chamber 192 is much larger than that provided by the supply pump and advancing motion of the piston therefore occurs only between pumping strokes.

Flow from chamber 192 through passage 197 is not prevented by reed valve 196 said flow being controlled only by the position of servo piston 186.

Similarly $N^2$ control pressure from conduit 180 controls the axial position of fuel limiting plunger 178 by controlling the addition to, and the dumping from, the chamber 202 of fuel by the position of the servo valve 204 relative to plunger 178.

Figure 4:
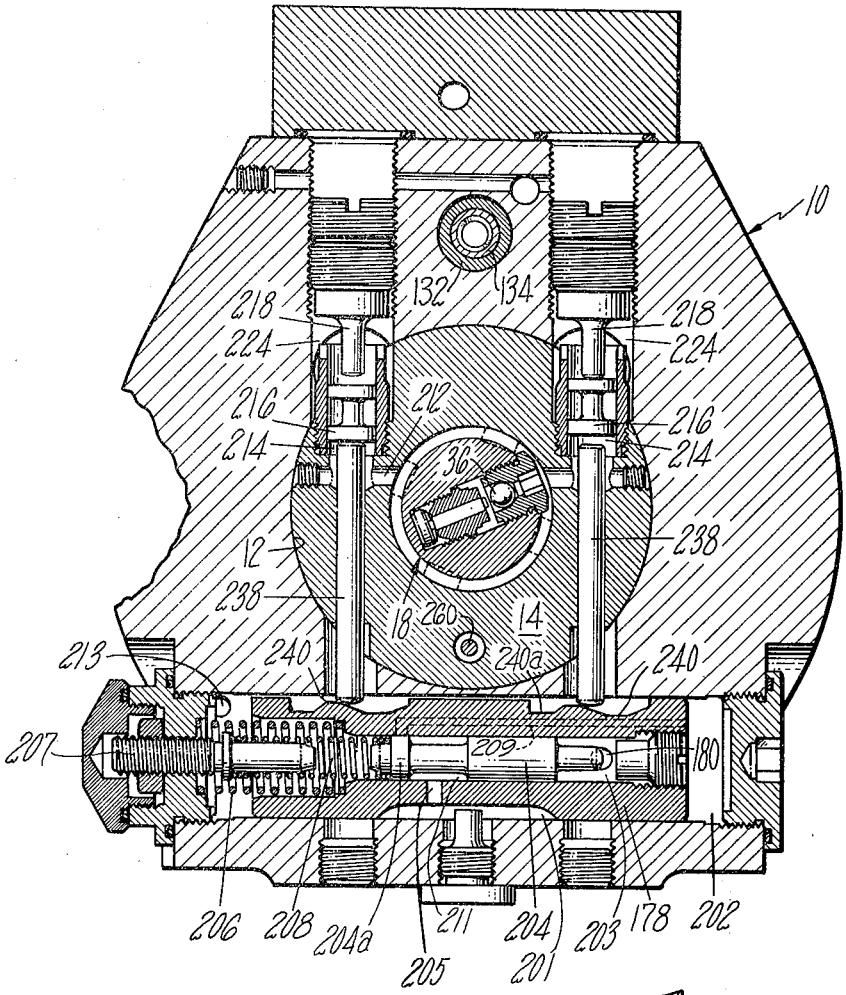
FIG. 4 is a cross-sectional view taken along the line 4—4 of FIG. 1.

As shown on FIG. 4, the cavity 201 communicates with conduit 190 and is connected to annulus 211 on valve 204 by passage 205. Fuel at $N^2$ control pressure enters chamber 203 at one end of valve 204 via conduit 180. At the opposite end of servo valve 204 is a bias spring 208 which is adjustable by means of screw 207. Servo valve 204 reaches a position of equilibrium when the pressure in chamber 203 equals the spring force of spring 208.

The torque limiting plunger 178 is provided with a passage 209 having a radial port into the servo valve chamber controlled by land 204A. Since conduit 190 delivers pressure from supply pump 22 to the annulus 211, additional fuel may enter the chamber 202 when the land 204A is to the left relative to the port of conduit 209, and trapped fuel in chamber 202 is dumped from chamber 202 when the port is to the left of the land 204A to control the axial position of torque limiting plunger 178 according to engine speed.

As previously described, metering valve 134 controls the amount of restriction offered to the flow of fuel through the triangular metering port 32 to maintain the speed of the associated engine despite varying loads. Fuel that passes through the metering port 32, flows to a groove 34 on the rotor 18.

Upon the registry of axial slot 210 (FIG. 2) which communicates with groove 34 on the rotor 18 with the port 212 during the rotation of the rotor, metered fuel is delivered to shuttle space 214 to move the shuttle 216 upwardly from its position of rest on stop 238. If the metering valve is wide open, the shuttle 216 is moved upwardly until it contacts fixed stop 218. If the metering valve 134 only partially open, upward velocity of the shuttle 216 is reduced and the termination of the registry of slot 210 of the rotor and the port 212 limits the upward movement of the shuttle prior to its contact with fixed stop 218. During the shuttle filling period, slot 222 on the rotor and port 220 are also in registry, as shown in FIG. 2, to dump the fuel in the shuttle space 224 above the shuttle 216 back to the tank through passages 228 and 158, and housing pressure regulator 160.

Figure 3:
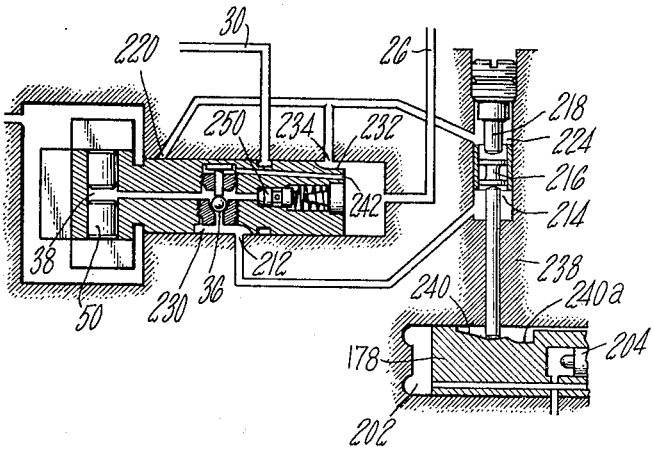
FIG. 3 is a partial schematic view similar to FIG. 2 showing a sequence during the charging of the pump chamber.

Continued rotation of the rotor 18 causes axial slot 230 to move into registry with the port 212 and slot 232 to move into registry with port 234, as shown in FIG. 3. As a result, pressurized fuel from inlet pump 22 is delivered by passage 26 to shuttle space 224 to force the shuttle downward against stop 238 and serve as a positive displacement pump to deliver the charge of fuel previously delivered to shuttle space 214 into the pump chamber 38 (FIG. 1) past ball valve 36. The charge of fuel so delivered to the pump chamber 38 is equal to shuttle displacement. This charge is pumped into the pump chamber 38 by a pressure dependent only on the output pressure of inlet pump 22.

Further rotation of the rotor 18 causes the axial slots 230 and 232 to pass out of registry with ports 212 and 234, respectively, to conclude the charging of pump chamber 38 with shuttle 216 against stop 238.

It will be apparent that the fuel dumped from shuttle space 224, during the delivery of the metered charge of fuel to shuttle space 214, will be equal to the metered charge delivered to pumping chamber 38. Since such dumped fuel is returned to the tank, it is further apparent that this shuttle feeding of fuel to pump chamber 38 results in the entry of new cool fuel to the pump at least equal to twice the output of the pump.

Immediately after the end of the charging sequence, the pressure in rotor passage 40 decreases to the same level as housing pressure, and the pressure in passage 242, which is in continuous communication with the pressurized output of inlet pump 22 through passage 26 moves inlet ball check closer piston 244 upwardly to seat the ball 36 prior to the rotation of a roller 68 up a cam lobe of cam ring 60 and the resulting pressurization of the fuel in chamber 38.

The diameter of closer piston 244 is smaller than the seating diameter of ball 36 so that, despite the fact that supply pump pressure acts on each in opposition to the other during the delivery of a metered charge of fuel to pump chamber 38, the closer piston 244 does not prevent opening motion of ball 36 and charging flow is permitted.

As shown in FIG. 1, the highly pressurized fuel from pump chamber 38 is discharged through the axial passage 40, past delivery valve 41 into delivery chamber 42, and by diagonal passage 44 to a passage 46, with which the passage 44 registers during the pumping stroke, for injection into a cylinder of the associated engine.

The delivery valve 41 is of the volume retraction type so that as the rollers 68 reach the tops of the cam lobes to terminate the forward flow of fuel in passage 40, the spring 43 moves the delivery valve 41 to the left, as viewed in FIG. 1, to a position where cuff 45 overlies shoulder 47 to prevent reverse flow past delivery valve 41 by way of external flutes 52. Further mvoement of the delivery valve adds a prescribed increase of space to be occupied by the fuel trapped downstream of valve 41.

A feature of the invention is that the unique delivery valve disclosed provides a flat seat seal wherein the pressure of the trapped fuel in chamber 42 and spring 43 provide the biasing force for the seal. As shown, the delivery valve is provided with a flat end which seats against a transverse end wall 49 to form the seal.

Moreover, the end of delivery valve 41 is provided with a recess 51 aligned with passage 40. The recess is displaced or offset from the seal surface so that any cavitation erosion due to the sudden reduction in pressure in passage 40 and the inertia of the fuel therein does not damage the seal surfaces between delivery valve 41 and the annular shoulder 49 which are perpendicular to the axis of passage 40.

Following injection, a short axial slot 244 on rotor 18 momentarily registers with the passage 46, to relieve any high residual pressure which may be present in the passage 46 in the event of a plugged nozzle. As shown slot 244 is connected to annulus 256, passage 258, and a pressure relief valve 260 which limits the maximum residual pressure in the passage 46 between injections to a safe level, say, 1500 psi, and prevents the maximum pressure generated during injection from progressively building-up to a destructive level despite the presence of a plugged nozzle and repeated injections of a charge of fuel thereto. This limits the side loading imposed on the rotor by the pressure in a passage 46.

As indicated above, the pumping plungers 50 are moved rapidly outwardly during the charging of pump chamber 38. This displaces the fuel which occupied the space radially outwardly of the plungers 50 immediately preceeding the charging of the pump chamber and results in a sudden pressure impulse up to, say, 80 psi. Such pressure pulses are repetitious and would normally have a deleterious effect on resilient seals such as shaft seals 15 exposed thereto. This invention provides a novel means for protecting shaft seals 15 from the harmful effect of these pressure pulses.

Figure 1A:
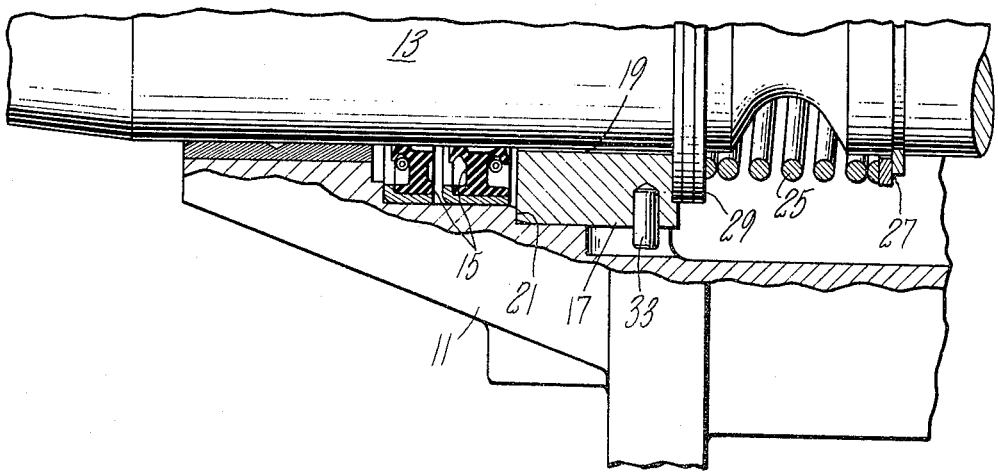
FIG. 1A is a fragmentary cross-sectional view of the drive shaft assembly of the pump of FIG. 1.

As shown in FIG. 1A, a pressure shield in the form of an annular dam 17 is disposed between the shaft seals 15 and fuel within the housing 11 which is subjected to the pressure spikes. The dam 17 is preferably formed of aluminum and is spaced from shaft 13 by a narrow annular gap 19 which offers a restricted passage to the flow of fuel therethrough and dampens the pressure spikes imposed on seals 15.

The dam 17 abuts a shoulder 21 and is secured against rotation by a pin 33. A spring 25 seated against a ring 27 and a ring 29 biases the shaft 13 toward rotor 18 to maintain the engagement of tank 31 of shaft 13 with a mating slot of rotor 18.

Since the axial position of movable stop 238 is set by the profile of cam surface 240 of fuel limiting plunger 178 in accordance with engine speed as previously described, it is apparent that by shaping the profile of cam surface 240, the maximum shuttle movement at different engine speeds can be easily adjusted to provide any desired schedule of maximum fuel delivery versus speed, and therefore, a torque curve customized for any engine and, if the profile includes a recess such as shown at 240A, excess fuel for starting may be easily incorporated in the pump design.

The functioning of the shuttle 216 and the feeding of metered charges of fuel to the pump chamber 38 has been described in connection with a single shuttle 216. In practice, a pair of identical shuttles, as shown in FIG. 4, are used. These identical shuttles function alternatively for delivering a charge of fuel to the pump chamber 38 with the distributor rotor 18 being provided with a plurality of each of the slots 222, 230, 210, and 232 around its periphery for sequential registration with the passages associated with the two shuttles. The use of two shuttles, halves the number of slots 230 and 210 which are required.

A feature of this invention, as shown in FIG. 4, is that a pair of shuttles 216, while alternating in the delivering of fuel to the pump chamber 38 and involving a design subject to charge-to-charge variation due to manufacturing differences such as the length of the stems 238, and the shuttles 216, are constructed to prevent such variations. As shown in FIG. 4, the stops at both ends of the shuttles 216 are accessible for adjustment or control. Where fixed stops 218 are used, they threadably engage their respective bores and may be precisely adjusted by bottoming the stops and then backed off a precise number of turns to provide precise vernier calibration of the maximum travel of the shuttles and hence the maximum charge of fuel delivered by the two shuttles.

As further shown in FIG. 4, the shuttle mechanism includes a light-weight low inertia shuttle 216, and an elongated massive stop 238. Not only does this design produce a faster response time of the shuttle, but is also results in shuttle chamber 214 for the metered fuel which is effectively sealed against leakage by the long path between stem 238 and its bore. Further since the mass of stem 238 is substantially greater than the mass of shuttle 215, the stem serves as an energy absorber for the shuttle 216, and reduces impact loading between stops 238 and cam surfaces 240.

Figure 5:
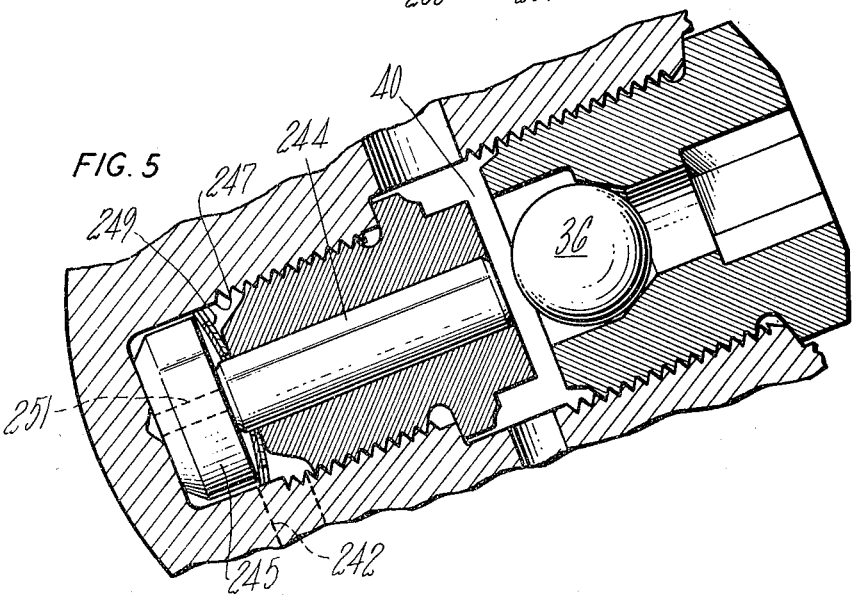
FIG. 5 is an enlarged fragmentary cross-sectional view of the rotor mounted ball check mechanism of FIG. 1.

As shown in FIGS. 1 and 5, one end of the ball check valve closer piston 244 is subjected to the high pressure impulsed generated in the pump chamber 38. As a result, these forces drive the closer piston 244 against its stop 245 at high velocity when pumping starts. This invention provides means for cushioning the shock that would normally occur as the closer piston strikes the stop. As best shown in FIG. 5, the stop 245 is formed by a hardened button which is held against the bottom of the recess 247 for the closer piston 244. A spring washer 249 tightly biases the stop 245 against the bottom wall of recess 247. The end of the closer piston 244 and the mating surface of the stop 246 are flat so that, as the closer piston reaches the stop 246 at high speed, the fuel therebetween must be squeezed out and serves to cushion the termination of movement of piston 244. In addition, the button 246 is provided with a central passage 251 which being filled with fuel, serves as a surge chamber with the fuel therein pressurized to assist in cushioning the impact and inhibiting cavitation.

As shown in FIG. 5, closer piston is elongated and its cross-section is small to provide a high length-to-diameter ratio. As a result, an effective seal is provided between the high pressure passage 40 and the laterally directed passage 242 along the full length of closer piston 244 to substantially eliminate the possibility of leakage of high pressure metered charges of fuel.

As will be apparent to persons skilled in the art, various modifications, adaptations and variations of the foregoing specific disclosure can be made without departing from the teachings of the present invention.

We claim:

1. A liquid fuel injection pump comprising a supply tank, a low pressure supply pump having an inlet connected to said supply tank, a rotor mounting a high pressure pump which pressurizes measured charges of fuel for sequential delivery to the cylinders of an associated engine in timed relation therewith, a first passage connecting the outlet of said supply pump and said high pressure pump, a movable metering valve in said passage for controlling the restriction offered by a metering port to control the fuel delivered to said high pressure pump, and a bypass passage connecting said first passage to said supply tank and having a normally closed bypass port opened by said metering valve as said metering valve approaches its closed position to continue the circulation of new fuel from said tank through the fuel injection pump whenever said metering valve is closed.

2. The fuel injection pump of claim 1 wherein said bypass passage includes a pressure regulating valve to maintain a predetermined pressure level on the fuel in said bypass passage.

3. The fuel injection pump of claim 1 wherein the metering valve is axially slideable in a bore and the metering port and the bypass port are relatively displaced axially along the bore.

4. The fuel injection pump of claim 1 wherein said supply pump is mounted at one end of the rotor and the inlet therefor is disposed at the end thereof remote from said rotor, said supply pump having a regulating valve also disposed at said end of said supply pump remote from said rotor to dump a portion of the output of said supply pump into said inlet thereby to isolate the heat absorbed by the fuel recirculated through said supply pump from the rotor.

5. The fuel injection pump of claim 4 wherein said regulating valve is disposed coaxially with said rotor and with said inlet from said tank.

* * * * *